US006536764B1

(12) United States Patent
Spitzer

(10) Patent No.: US 6,536,764 B1
(45) Date of Patent: Mar. 25, 2003

(54) PUZZLE HAVING MOVABLE PIECES AND CONNECTING LINKAGES

(75) Inventor: Lynn Spitzer, Philadelphia, PA (US)

(73) Assignee: The Toy Hatchery, Inc., Philadelphia, PA (US)

( * ) Notice: Subject to any disclaimer, the term of this patent is extended or adjusted under 35 U.S.C. 154(b) by 0 days.

(21) Appl. No.: 09/496,483

(22) Filed: Feb. 2, 2000

(51) Int. Cl.[7] ..... A63F 9/08
(52) U.S. Cl. ..... 273/153 S; 273/155
(58) Field of Search ..... 273/153 R, 153 S, 273/155, 156, 157 R; 446/111, 112, 113, 115

(56) References Cited

U.S. PATENT DOCUMENTS

| | | | | |
|---|---|---|---|---|
| 487,318 A | | 12/1892 | Clark | |
| 2,022,319 A | | 11/1935 | Meyercord | |
| 2,245,875 A | * | 6/1941 | Rutherford | 273/155 |
| 3,201,894 A | | 8/1965 | Resch | |
| 3,487,578 A | | 1/1970 | Sudermann | |
| 3,981,505 A | | 9/1976 | Odier | |
| 4,483,535 A | | 11/1984 | LeCart | |
| 4,735,418 A | | 4/1988 | Engel | |
| 4,793,615 A | | 12/1988 | Martin | |
| 4,875,681 A | * | 10/1989 | Ofir | 273/155 |
| 5,108,100 A | | 4/1992 | Essebaggers et al. | |
| 5,110,130 A | * | 5/1992 | Aulicino | 273/155 |
| 5,299,804 A | * | 4/1994 | Stevens | 273/155 |
| 5,302,148 A | * | 4/1994 | Heinz | 273/153 S |
| 5,344,148 A | * | 9/1994 | Asch | 273/156 |
| 5,445,380 A | | 8/1995 | Polsky | |
| 5,735,520 A | | 4/1998 | Matos | |

* cited by examiner

*Primary Examiner*—Steven Wong
(74) *Attorney, Agent, or Firm*—Grimes & Battersby, LLP

(57) ABSTRACT

A plurality of hexagonal puzzle pieces are formed of a pair of spaced apart hexagonal plates having a detent column extending between their respective inner surfaces. A plurality of linkages each having ring portions are received upon the detent columns of each puzzle piece to join the puzzle pieces in an elongated string. The angular positions between adjacent puzzle pieces as well as the rotational position of each puzzle piece within the string of puzzle pieces may be changed or manipulated in order to configure the puzzle pieces in a closed or solved puzzle configuration. A detent mechanism is operative between each puzzle piece and its adjacent puzzle piece to detent the relative positions thereof at selected angular relationships.

13 Claims, 2 Drawing Sheets

PUZZLE HAVING MOVABLE PIECES AND CONNECTING LINKAGES

FIELD OF THE INVENTION

This invention relates generally to puzzles and particularly to those utilizing a plurality of interconnected pieces capable of multiple configuration and defining a "solution" configuration to solve the puzzle.

BACKGROUND OF THE INVENTION

Amusement devices utilizing a plurality of pieces or elements which are capable of variable geometric arrangement are well known in the art. Such devices are typically referred as "puzzles" and most are capable of a variety of orientations and configurations. In such puzzles, the typical solution to the puzzle is found in obtaining a predetermined arrangement or configuration of the puzzle pieces. Often, the external surfaces of the puzzle pieces are variously colored or decorated utilizing a variety of number or letter characters or plural segments of a common picture or artwork.

While a great variety of such puzzle amusement devices have been provided by practitioners in the art, such puzzles may be generally divided as either folding puzzles, sliding piece puzzles or those having a plurality of puzzle pieces with interconnecting elements.

So-called folding piece puzzles are usually fabricated of one or more planar sheets having pluralities of fold lines and/or edges formed therein. Such puzzles are solved by folding the combination into a predetermined configuration. For example, U.S. Pat. No. 5,735,520 issued to Matos sets forth an FOLD-THROUGH PICTURE PUZZLE which includes a single base sheet, a plurality of superposed attached sheet bases, a single sheet base folded to form a three-dimensional object or plural sheet bases attached to form a three-dimensional object. Each fold-through picture puzzle is continually foldable in a first forward direction and during folding forms assembled images from respective cooperating image portions.

U.S. Pat. No. 5,445,380 issued to Polsky sets forth a FOLDING PICTURE PUZZLE having a rectangular multi-picture member which includes a flat base sheet material having a patchwork of partial picture images printed on at least one playing side. The sheet is additionally subdivided into at least sixteen equal and uniform squares by a combination of score lines and cuts.

U.S. Pat. No. 4,735,418 issued to Engel sets forth a PUZZLE AMUSEMENT DEVICE having flat strips of equilateral triangles hinged together at their edges. The strips may then be folded at the hinges and end triangles connected together to form a twisted loop having the overall form of a flattened hexagon.

Typical sliding puzzles provide some sort of supporting surface often surrounded by a boundary or frame within which one or more puzzle elements are movable between alternative positions. For example, U.S. Pat. No. 4,793,615 issued to Martin sets forth a PUZZLE WITH MOVABLE PIECES having a single plane base on which are mounted movable puzzle pieces. The pieces are restrained in a fixed series of grooves and may be arranged in a desired pattern. The pieces are scrambled in a random arrangement prior to game play which involves moving the pieces to obtain a predetermined arrangement.

U.S. Pat. No. 487,318 issued to Clarke sets forth a PUZZLE in which a plurality of pieces are enclosed within a box. Some of the pieces are triangular forming various letter arrangements and combinations to solve the puzzle.

U.S. Pat. No. 2,022,319 issued to Meyercord sets forth a MYSTERY PUZZLE having a plurality of pieces which bear segments or portions of a common picture and which are arranged to form the desired picture image solution in combination.

Puzzle utilizing interconnected pieces which often comprise polygons and linkages configured to define three-dimensional solutions are also provided in great variety. For example, U.S. Pat. No. 5,108,100 issued to Essebaggers, et al. sets forth a PYRAMID PUZZLE FORMED FROM TETRAHEDRAL AND OCTAEDER PIECES CONNECTED BY A STRAND sets forth a puzzle having a plurality of three-sided pyramids and four small octaeder-shaped bodies all of which are connected to a string forming an endless chain. The solution of the puzzle is obtained by placing the smaller parts of the puzzle in such a manner that a large pyramid is formed which is uniformly colored by the smaller pieces.

U.S. Pat. No. 4,483,535 issued to LeCart sets forth a TRIANGLE COMBINATION GAME utilizing a equilateral triangle assembly of hexagonal form subassemblies wherein adjacent subassemblies share two common components and are held together in a manner facilitating rotation of each subassembly around its own center.

U.S. Pat. No. 3,981,505 issued to Odier sets forth a PUZZLE WITH IRREGULAR PENTAGONAL PIECES each piece having an identical shape defined by an irregular pentagon. The puzzle pieces may be placed on a planar supporting surface in a side-to-side abutment to fully cover the surface and in a variety of alternate configurations.

U.S. Pat. No. 3,201,894 issued to Resch sets forth a GEOMETRICAL DEVICE HAVING ARTICULATED RELATIVELY MOVABLE SECTIONS in which a plurality of three-dimensional objects are interconnected by hinged couplings in a manner facilitating alternative arrangements between the three-dimensional devices. The solution is generally defined as one of a selected type of possible arrangements.

U.S. Pat. No. 3,487,578 issued to Sudermann sets forth an ARRAY OF BLOCKS JOINED BY DOUBLE-ACTING HINGE MEANS in which a plurality of equally sized cubes are respectively coupled to adjacent cubes by pairs of opposed crossing filament elements. The opposed pairs of filament elements facilitate the multiple arrangements of the cubes to provide alternate puzzle configurations including a predetermined solution configuration.

While the foregoing described prior art devices have generally improved the art and in some instances enjoyed commercial success, there remains a continuing need in the art for evermore interesting, amusing and convenient puzzles and puzzle apparatus.

SUMMARY OF THE INVENTION

Accordingly, it is a general object of the present invention to provide an improved puzzle. It is a more particular object of the present invention to provide an improved puzzle which is convenient to carry, simple to use and economical to produce but remains challenging in its solution and manipulation.

In accordance with the present invention, there is provided a puzzle configurable between a solved configuration and an open configuration, the puzzle comprising: a plurality of puzzle pieces, each puzzle piece having a pair of faceted plates and a detent column joining the pair of plates; and a plurality of linkages, each linkage including a pair of rings joined by a link, each of the rings encircling the detent columns of adjacent puzzle pieces to couple a pair of adjacent puzzle pieces, the detent columns and the rings constructed to cooperatively join the puzzle pieces in a coupling which facilitates rotation of the puzzle pieces individually and rotation of the puzzle pieces about an adjacent puzzle piece.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 2:
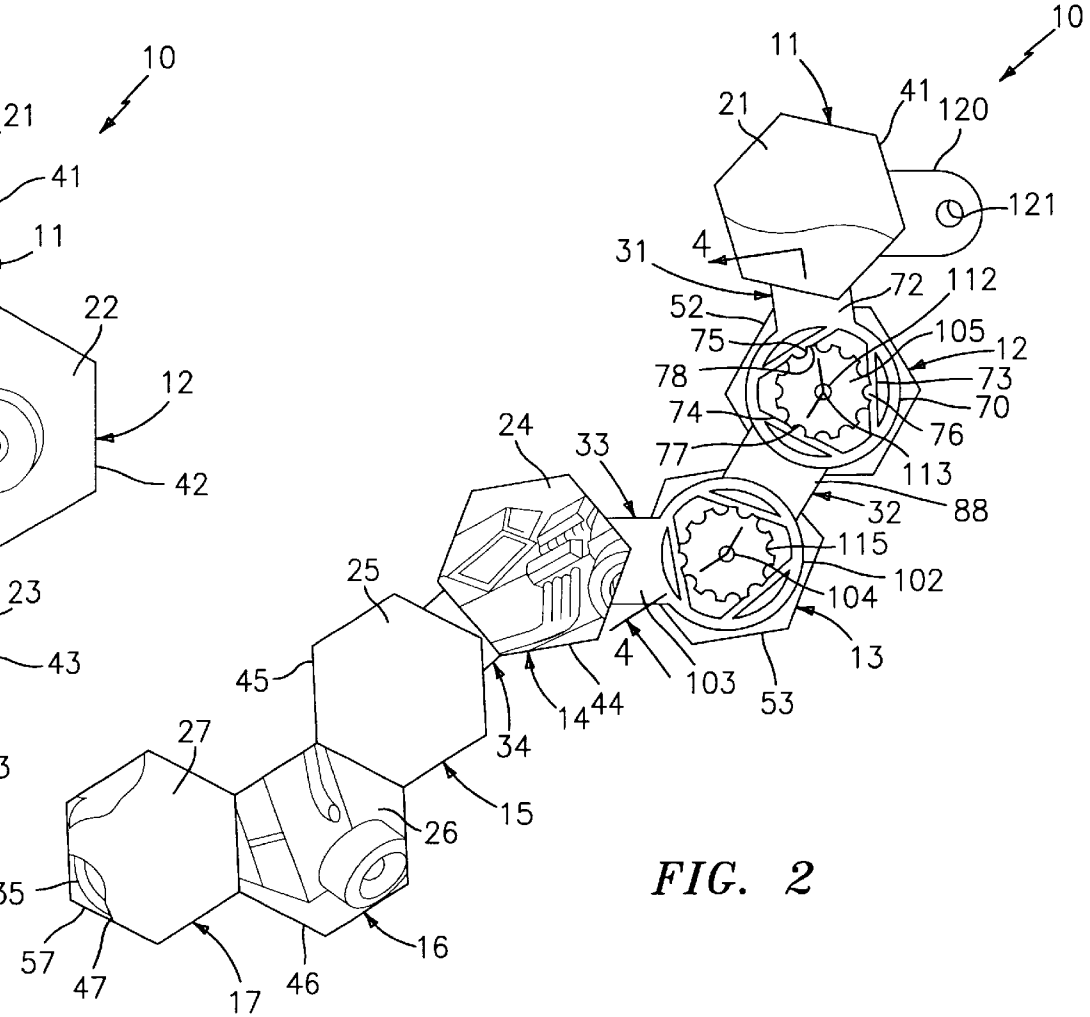
FIG. 2 sets forth a partially sectioned view of the present invention puzzle in an extended configuration.
Figure 1:
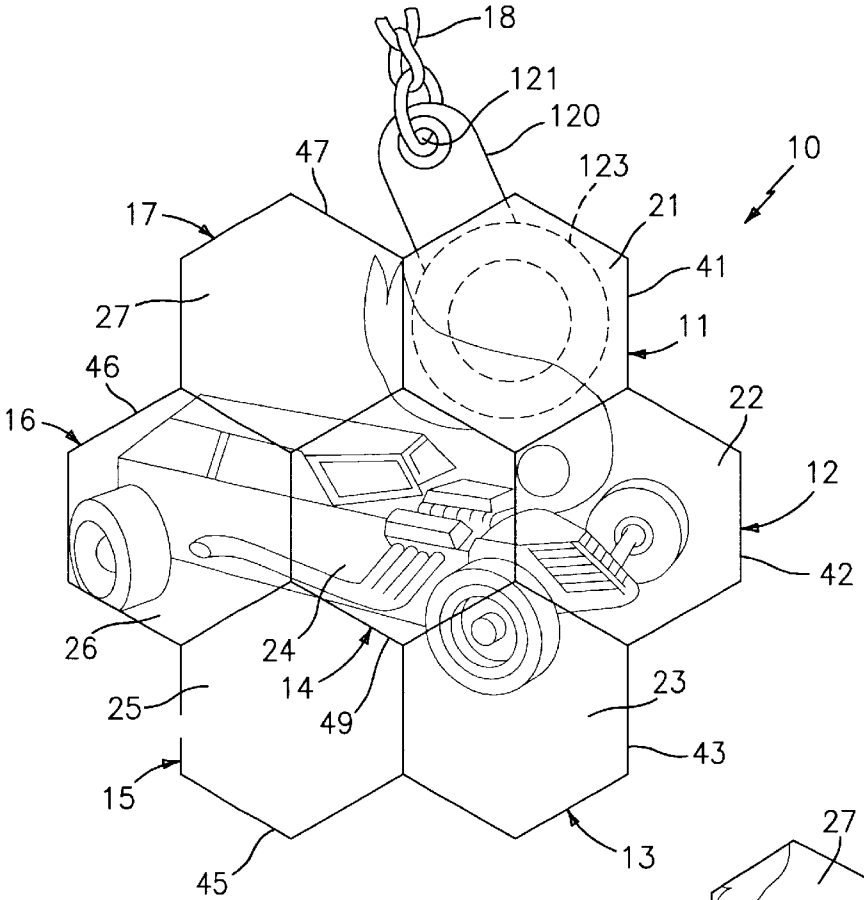
FIG. 1 sets forth a planar view of the present invention puzzle in a solved configuration.

FIG. 1 sets forth a planar view of a puzzle constructed in accordance with the present invention and generally referenced by numeral 10. Puzzle 10 is shown in FIG. 1 in its closed or correctly solved configuration. Puzzle 10 includes a plurality of substantially identical puzzle pieces 11, 12, 13, 14, 15, 16 and 17 each having a hexagonal shape and each defining respective surfaces 21, 22, 23, 24, 25, 26 and 27. Puzzle pieces 11 through 17 are substantially identical and, as is set forth below in greater detail, are each formed of a pair of hexagonal plates spaced apart by a detent column such as detent column 105 seen in FIG. 3 for puzzle piece 12. In accordance with the present invention, each puzzle piece is coupled to its adjacent puzzle piece in a straight line arrangement such as seen in FIG. 2 by an interconnecting linkage. Thus, with temporary reference to FIG. 2, it will be noted that puzzle pieces 11 and 12 are coupled by a linkage 31 while puzzle pieces 12 and 13 are coupled by a linkage 32 and puzzle pieces 13 and 14 are coupled by a linkage 33 and so on. The linkage couplings between adjacent puzzle pieces is substantially identical with the exception of puzzle pieces 11 and 17 which, as is better seen in FIG. 2, form opposite ends of the chain of puzzle pieces. In puzzle piece 11, a spacer ring 123 is joined to puzzle piece 11 instead of an additional linkage to an adjacent puzzle piece. Spacer ring 123 is further joined to an extending tab 120 having an aperture 121 formed therein. Aperture 121 may, for example, be joined to a conventional key chain 18 or other suitable carrying device as desired by the user. Similarly, puzzle piece 17, which as is mentioned above is coupled to puzzle piece 16 by a linkage, is an end piece on the chain of puzzle pieces and therefore does not require a second linkage in attachment thereto. Accordingly, a spacer ring 35 having a generally annular shape is received within puzzle piece 17.to properly space the linkage which joins puzzle pieces 16 and 17 (not shown). The remaining puzzle pieces are each mutually joined to an adjacent puzzle piece on each side by a pair of oppositely oriented linkages, each of which is identical to linkages 31 and 32 seen in FIG. 3.

With respect to the closed configuration of puzzle 10 shown in FIG. 1, it will be noted that puzzle pieces 11 through 17 define respective surfaces 21 through 27 which in turn support various portions of a combined image. In the example of FIG. 1, a fanciful representation of a custom car is depicted in the combined image. However, it will be apparent to those skilled in the art that other images may be utilized on the surfaces of the puzzle pieces without departing from the spirit and scope of the present invention. It will be further apparent to those skilled in the art that, while not seen in FIG. 1, each of puzzle pieces 11 through 17 is able to support a second combined image on the opposite surfaces of the puzzle pieces in the identical manner to that shown in FIG. 1 for surfaces 21 through 27.

As mentioned above and as is set forth below in FIGS. 3 and 4, each of puzzle pieces 11 through 17 is formed of a pair of identical spaced apart plates having hexagonal shapes. Accordingly, plates 41 through 47 of puzzle pieces 11 through 17 are shown interlocking and fitted together in the closed configuration of FIG. 1 which represents a correct "solution" to the puzzle. Once again, while not seen in FIG. 1, it will be understood from the example set forth in FIGS. 3 and 4 of puzzle piece 12 which is understood to be equally representative of puzzle piece 11 and puzzle piece 17 that each of puzzle pieces 11 through 17 includes an identical plate on the opposite side from plates 41 through 47. By way of example and with temporary reference to FIG. 2, puzzle pieces 12 and 13 are shown in partial section having hexagonal plates 52 and 53 which are identical to plates 42 and 43 seen in FIG. 1.

In the closed configuration of FIG. 1, puzzle 10 may be carried as a keychain charm or keyfob as desired by the user. Puzzle 10 is played in a problem-solving mode by simply unraveling puzzle 10 from the closed configuration of FIG. 1 to the open configuration of FIG. 2. Thereafter, the user endeavors to pivot puzzle pieces 11 through 17 and restore them to the closed configuration shown in FIG. 1. To add challenge to the solving of puzzle 10, it will be noted that in the manner described below, each pair of hexagonal plates of each puzzle piece is rotatable to a variety of angular positions in addition to the movement about its adjacent puzzle pieces. This adds further interest and challenge to puzzle 10. For example, the arrangement of puzzle pieces in the closed configuration of FIG. 1 could be obtained without the correct rotational position of the puzzle pieces. In such case, the combined image would not be correctly formed and the puzzle even though moved to a closed configuration would not be correctly solved. Thus, the challenge presented to the user is the configuration of the puzzle pieces in the correct manner to form the closed configuration of FIG. 1 and the correct rotational position of each puzzle piece.

FIG. 2 sets forth puzzle 10 in an open configuration showing the generally linear arrangement of puzzle pieces 11 through 17. As described above, puzzle pieces 11 through 17 are substantially identical with the exception of the changes to puzzle pieces 11 and 17 in view of their end positions on the puzzle piece chain. Accordingly, puzzle piece 11 includes a hexagonal plate 41 defining a surface 21. Puzzle piece 11 further includes a tab 120 having an aperture 121 formed therein. As mentioned above, tab 120 is secured within puzzle piece 11 by a spacer ring 123 (seen in FIG. 1). Puzzle piece 12 includes a hexagonal plate 52, a detent column 105 and a hexagonal plate 42 (seen in FIG. 1). Plate 42 supports a post 113 which is received within a bore 112 of detent column 105. The cooperation of post 113 and bore 112 provides the attachment of plates 42 and 52 (plate 42 seen in FIG. 1). A linkage 31 includes a link 72 joined to a ring 70 having a substantially annular shape which encircles detent column 105. Ring 70 further supports a plurality of chords 73, 74 and 75, each supporting respective inwardly extending projections 76, 77 and 78. Chords 73, 74 and 75 are preferably formed as integral parts of ring 70 from a somewhat resilient material such as molded plastic or the like. While not seen in FIG. 2, it will be understood that linkage 31 further includes a second ring and plurality of chords identical to ring 70 and chords 73 through 75 as well as projections 76 through 78 which are received upon puzzle piece 11. As mentioned above, puzzle piece 12 supports a detent column 105 having a bore 112 formed therein. Detent column further defines a plurality of detent recesses 106 through 111 (seen in FIG. 3). Projections 76 through 78 cooperate with detent recesses 106 through 111 of detent column 105 to detent the relative position between ring 70 of linkage 31 and puzzle piece 12. This detenting action is overcome as puzzle piece 12 and linkage 31 are rotated relative to each other with sufficient force to cause chords 73 through 75 to flex outwardly thereby allowing projections 76 through 78 to be forced from their respective detent recesses at any given rotational relationship between linkage 31 and puzzle piece 12. Thus, a rotation of puzzle piece 12 without movement of adjacent puzzle piece 11 may be attained by overcoming the detent action of puzzle piece 12 and linkage 31. Similarly, the angular or rotational relationship between puzzle pieces 11 and 12 may be changed by moving puzzle piece 11 with respect to puzzle piece 12 with sufficient force to overcome the detent action described above.

Puzzle piece 13 is substantially identical to puzzle piece 12 and thus is formed of a hexagonal plate 53 supporting a detent column.115. A second hexagonal plate 43 (seen in FIG. 1) is secured to plate 53 by a post 104. A linkage 32 includes a link 88 and a pair of rings 86 and 87 (seen in FIG. 3). The structure of linkage 32 and its coupling to puzzle pieces 12 and 13 is set forth below in FIGS. 3 and 4 in greater detail. However, suffice it to note here that linkage 32 provides a detented coupling between puzzle pieces 12 and 13 which is identical to the coupling of ring 70 and detent column 105 of puzzle piece 12.

A linkage 33 substantially identical to linkages 31 and 32 (seen in FIG. 3) defines a ring 102 and is received upon detent column 115 of puzzle piece 13. Linkage 33 includes a link 103 which is coupled to a ring and chord combination which is not seen in FIG. 2 but which will be understood to be identical to ring 102.

Puzzle pieces 14, 15, 16 and 17 are mutually joined by linkages such as linkage 34 in an identical attachment to the attachment between puzzle pieces 12 and 13 to form the remainder of the string of puzzle pieces of puzzle 10. Accordingly, puzzle piece 14 having a hexagonal plate 44 defining a surface 24 is joined to puzzle piece 15 by a linkage 34 correspondingly, puzzle pieces 15, 16 and 17 having respective hexagonal plates 45, 46 and 47 which in turn respective surfaces 25, 26 and 27 are similarly joined by linkages in the manner described above. As mentioned above, puzzle piece 17 differs from puzzle pieces 12 through 16 in accordance with its end position in the string of puzzle pieces by the substitution of a spacer ring 35 for a second linkage which would otherwise further join puzzle piece 17 to the next adjacent puzzle piece were it not in an end position. Thus, it will be understood that puzzle pieces 16 and 17 are joined by a linkage in the same manner as puzzle pieces 12 and 13. Spacer ring 35 maintains the correct position of the joining linkage and makes up for the absence of a second linkage coupled to puzzle piece 17.

It will be apparent to those skilled in the art that while the embodiment of the present invention shown is preferred, other embodiments may also be provided within the spirit and scope of the present invention. For example, the present invention is not limited to hexagonal plates. Plates which define different numbers of facets such as pentagons, square and triangular may also be used without departing from the present invention.

Figure 3:
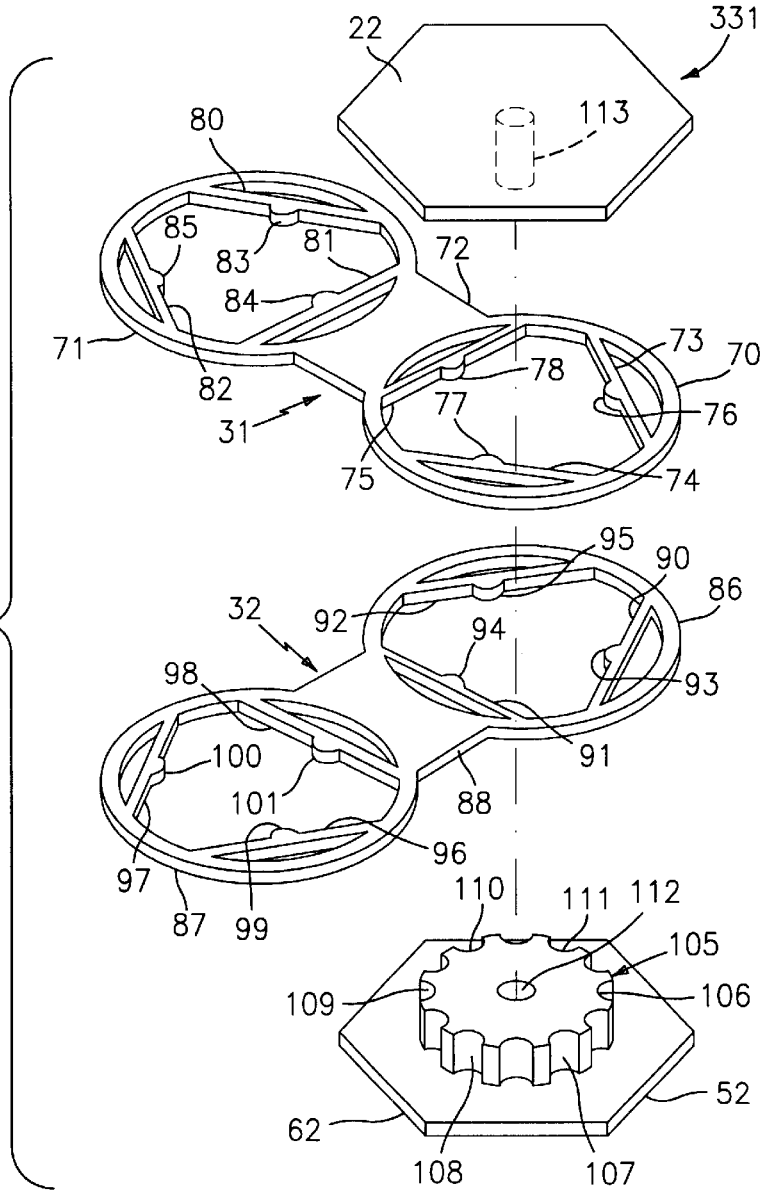
FIG. 3 sets forth a perspective assembly view of a typical piece and interconnecting linkage arrangement.

FIG. 3 sets forth a perspective assembly view of puzzle piece 12 together with the pair of linkages (linkages 31 and 32) which are coupled to puzzle piece 12 and which are utilized to further join puzzle piece 12 to adjacent puzzle pieces 11 and 13 (seen in FIG. 2). Once again, it will be understood that the structure of linkages 31 and 32 together with puzzle piece 12 is exemplary and illustrative of the identical structures of puzzle pieces 11 and 13 through 17.

More specifically, puzzle piece 12 includes a pair of hexagonal plates 42 and 52 defining respective surfaces 22 and 62. Plate 52 supports a detent column 105 having a bore 112 and a plurality of detent recesses 106 through 111 formed therein. Detent recesses 106 through 111 are preferably spaced in an equal angle radial relationship to each other upon detent column 105. In the preferred fabrication of the present invention, plate 52 and detent column 105 are integrally formed of a molded plastic component or the like. Plate 42 defines a downwardly extending cylindrical post 113 which is sized to fit tightly within bore 112. In the preferred fabrication of the present invention, plate 42 is assembled to plate 52 by insertion of post 113 within bore 112 in an alignment which aligns the hexagonal facets of plates 42 with those of plate 52. Attachment of post 113 within bore 112 may utilize a simple tight or force-fit or, alternatively, may use a commercial form of attachment such as chemical adhesive or the like.

Linkage 31 includes a link 72 extending between a pair of annular rings 70 and 71. Ring 70 includes a plurality of resilient chords 73, 74 and 75 having respective inwardly extending projections 76, 77 and 78. Correspondingly, ring 71 supports a plurality of resilient chords 80, 81 and 82 supporting respective projections 83, 84 and 85.

Linkage 32 is identical to linkage 31 and includes a link 88 supporting a pair of rings 86 and 87. Ring 86 includes a plurality of resilient chords 90, 91 and 92 supporting respective projections 93, 94 and 95. Similarly, ring 87 includes a plurality of resilient chords 96, 97 and 98 supporting inwardly extending projections 99, 100 and 101.

Puzzle piece 12 is assembled by initially placing ring 86 of linkage 32 upon detent column 104 and thereafter placing ring 70 of linkage 31 upon detent column 105 and thereafter assembling plate 42 to plate 52 by insertion of post 113 into bore 112. Once again, it will be understood that adhesive attachment or the like may be used to secure post 113 within bore 112. It will be further understood in the preferred embodiment of the present invention, plate 42 is aligned with plate 52.

Figure 4:
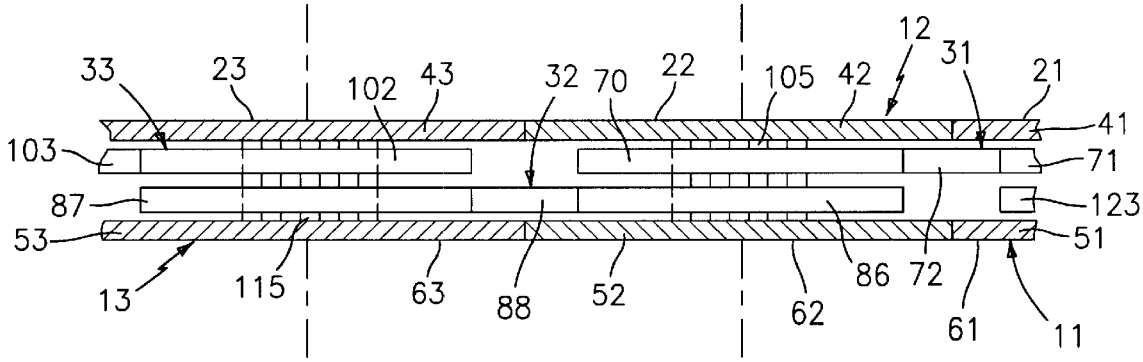
FIG. 4 sets forth a section view of a pair of puzzle pieces taken along section lines 4—4 in FIG. 2.

FIG. 4 sets forth a partial section view of puzzle 10 taken along section lines 4—4 in FIG. 2. FIG. 4 shows puzzle pieces 12 and 13 commonly joined by linkage 32. FIG. 4 also shows in part the further attachment of puzzle piece 13 to puzzle piece 14 (seen in FIG. 2) by linkage 33. Also shown in FIG. 4 is a portion of linkage 31 which joins puzzle piece 12 to puzzle piece 11.

More specifically, puzzle piece 12 includes a pair of plates 42 and 52 having respective outer surfaces 22 and 62 joined by detent column 105. Similarly, puzzle piece 13 includes a pair of plates 43 and 53 having respective outer surfaces 23 and 63 joined by detent column 115. Also, partially shown in FIG. 4 is puzzle piece 11 having plates 41 and 51 defining respective outer surfaces 21 and 61. A linkage 32 defines rings 86 and 87 received upon detent columns 105 and 115 in the manner described above which provides the detented attachment coupling between puzzle pieces 12 and 13. Linkage 33 includes ring 102 received upon detent column 115 together with link 103. Linkage 31 includes a ring 70 received upon detent column 105 together with a link 72 joined to a ring 71.

Thus, it can be seen from FIG. 4 that puzzle pieces 12 and 13 are commonly joined by linkage 32 and that puzzle piece 12 is further joined by linkage 31 to puzzle piece 11 while puzzle piece 13 is further joined to puzzle piece 14 (seen in FIG. 2) by a linkage 33. Once again it will be understood that the couplings and structure of puzzle pieces 12 through 16 are identical to the coupling shown between puzzle pieces 12 and 13 in FIG. 4. It will be further understood that puzzle piece 17 (seen in FIG. 2) is identically coupled to puzzle piece 16 in the manner shown in FIG. 4 with the difference being found in the replacement of ring 102 of linkage 33 with spacer ring 35 (seen in FIG. 2). Similarly, it will be understood that the coupling of puzzle piece 11 to puzzle piece 12 utilizes linkage 31 together with spacer ring 123.

What has been shown is a simple puzzle structure which nonetheless provides an interesting and amusing puzzle to be solved by the user. The puzzle provides substantial interest and challenge and in the closed or solved configuration may be further employed as a typical keyfob. The components of the inventive puzzle are readily fabricated of molded plastic components for economy and ease of manufacture.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A muzzle configurable between a solved configuration and an open configuration, said puzzle comprising:

a plurality of puzzle pieces, each puzzle piece having a pair of hexagonal plates and a column joining said pair of plates; and a plurality of linkages, each linkage including a pair of rings joined by a link, each of said rings encircling said columns of adjacent puzzle pieces to couple a pair of adjacent puzzle pieces, said columns and said rings constructed to cooperatively join said puzzle pieces in a coupling which facilitates rotation of said puzzle pieces individually and rotation of said puzzle pieces about an adjacent puzzle piece.

2. The puzzle set forth in claim 1 wherein said columns and said rings include detent means for detentably positioning said puzzle pieces at a plurality of rotational positions.

3. The puzzle set forth in claim 2 wherein said detent means include a plurality of detent recesses formed on each of said columns and a plurality of inwardly extending projections supported on each of said rings.

4. The puzzle set forth in claim 3 wherein each of said rings includes a plurality of resilient chords each supporting one of said projections.

5. The puzzle set forth in claim 4 wherein said solved configuration includes a center puzzle piece surrounded by the remainder of said puzzle pieces.

6. The puzzle set forth in claim 5 wherein said hexagonal plates define surfaces bearing components of an image and wherein said components form said image when said puzzle is in said solved configuration.

7. The puzzle set forth in claim 6 wherein one of said puzzle pieces includes an extending tab having an aperture formed therein.

8. The puzzle set forth in claim 1 wherein said hexagonal plates define surfaces bearing components of an image and wherein said components form said image when said puzzle is in said solved configuration.

9. The puzzle set forth in claim 1 wherein one of said puzzle pieces includes an extending tab having an aperture formed therein.

10. A puzzle comprising:

a plurality of hexagonal intermediate puzzle pieces;

a plurality of linkages rotatably joining said intermediate puzzle pieces in a serial attachment having first and second ends;

a pair of hexagonal end puzzle pieces; and a pair of linkages rotationally joining said pair of end puzzle pieces to said first and second ends, said intermediate puzzle pieces and send end puzzle pieces being freely rotatable in 360 degrees of rotation about a central axis and configurable in a solved configuration in which each of said intermediate puzzle pieces and said end puzzle pieces is in contact with at least one of the remaining intermediate puzzle pieces or said end puzzle pieces.

11. The puzzle set forth in claim 10 wherein said intermediate puzzle pieces and said end puzzle pieces each define first detent means and wherein said plurality of linkages and said pair of linkages each define second detent means, said first and second detent means cooperating to detentably position said intermediate and end puzzle pieces.

12. A puzzle configurable between a solved configuration and an open configuration, said puzzle comprising:

a plurality of puzzle pieces, each puzzle piece having a pair of faceted plates defining a polygon and a detent column joining said pair of plates; and a plurality of linkages, each linkage including a pair of rings joined by a link, each of said rings encircling said detent columns of adjacent puzzle pieces to couple a pair of adjacent puzzle pieces, said detent columns and said rings constructed to cooperatively join said puzzle pieces in a coupling which facilitates rotation of said puzzle pieces individually and rotation of said puzzle pieces about an adjacent puzzle piece.

13. The puzzle set forth in claim 12 wherein said detent columns and said rings include detent means for detentably positioning said puzzle pieces at a plurality of rotational positions.

* * * * *

UNITED STATES PATENT AND TRADEMARK OFFICE

CERTIFICATE OF CORRECTION

PATENT NO. : 6,536,764 B1
DATED : March 25, 2003
INVENTOR(S) : Spitzer

It is certified that error appears in the above-identified patent and that said Letters Patent is hereby corrected as shown below:

Column 7,
Line 39, replace the word “muzzle” with -- puzzle --.

Column 8,
Line 28, replace the word “send” with -- said --.
Lines 45, 49, 52 and 57, delete the term “detent”.

Signed and Sealed this

Twenty-second Day of June, 2004

JON W. DUDAS
*Acting Director of the United States Patent and Trademark Office*